United States Patent [19]

Gugel et al.

[11] Patent Number: 4,695,174

[45] Date of Patent: Sep. 22, 1987

[54] MAGNETIC CIRCUIT FOR MATRIX PRINT HEAD

[75] Inventors: Bernd Gugel, Ulm-Einsingen; Harald Niebel, Senden; Hubert Ott, Ravensburg, all of Fed. Rep. of Germany

[73] Assignee: Mannesmann Aktiengesellschaft, Duesseldorf, Fed. Rep. of Germany

[21] Appl. No.: 822,874

[22] Filed: Jan. 27, 1986

[30] Foreign Application Priority Data

Jan. 25, 1985 [DE] Fed. Rep. of Germany ..... 3502469

[51] Int. Cl.[4] ..... B41J 3/12

[52] U.S. Cl. ..... 400/124; 101/93.05

[58] Field of Search ..... 400/124; 101/93.05; 335/274

[56] References Cited

U.S. PATENT DOCUMENTS

| | | | |
|---|---|---|---|
| 4,136,978 | 1/1979 | Bellinger | 400/124 |
| 4,244,658 | 1/1981 | Mori | 400/124 |
| 4,348,120 | 9/1982 | Isobe | 400/124 |
| 4,433,926 | 2/1984 | Isobe | 400/124 |
| 4,498,791 | 2/1985 | Gilbert | 400/124 |

*Primary Examiner*—Paul T. Sewell

*Attorney, Agent, or Firm*—Ralf H. Siegemund

[57] ABSTRACT

A matrix print head includes a magnetic yoke plate, magnetic pole defining cores annularly arranged on the yoke plate, electromagnetic coils mounted on the cores, a permanent magnet plate arranged in magnetic conductive relationship to the yoke plate; the yoke plate, the cores, coils, and permanent magnet plate establishing an electromagnetic assembly, there being additionally an armature assembly including an armature plate and a plurality of deflectable radially extending armature arms, the armature assembly being arranged in relation to the electromagnetic assembly such that the armature arms cooperate with the electromagnetic cores, there being print elements such as styli connected to the armature arms; the improvement disclosed is comprised of the following features, the armature plate and the armature arms are physically separated from each other but resiliently interconnected to establish a single uncritical parasitic air gap; and the magnetic yoke and armature plates are radially, inwardly recessed vis-a-vis the permanent magnet plate. A radially inwardly and outwardly recessed intermediate plate is interposed between the permanent magnet and the armature ring.

6 Claims, 3 Drawing Figures

(A-B)

(A-B)

MAGNETIC CIRCUIT FOR MATRIX PRINT HEAD

BACKGROUND OF THE INVENTION

The present invention relates to a matrix print head particularly of the type used for serially writing, the characters to be composed in each instance of a plurality of dots; the print head is to be comprised basically of an assembly of electromagnets, and the assembly includes a common magnetizable yoke plate, magnetic cores mounted thereto for carrying electromagnetic coils and a permanent magnet to provide magnetic bias to all of the electromagnetically effective parts thus established; moreover, the print head is to include an armature assemby cooperating with but constituting otherwise a separate assembly from the electromagnetic coils and the electromagnetic assembly generally as defined, whereby the armature assemby is to be comprised basically of an armature plate and of a plurality of deflectible arms cooperating with the aforementioned cores and being provided for operating one or more print elements such that in case the arm of an armature is retracted to a first position which obtains from the permanent magnetic bias while through resilient force and through compensation of the permanent magnetic field by electromagnetic energization the stored resilient force of the armature arm causes the print element or elements to be propelled forward.

Matrix print heads of the type to which the invention pertains are usually provided in printers for movement in a reciprocating fashion along a printing platen. Whenever a particular print position is reached and when on account of selective control a particular print element is to be actuated, the magnetic field provided by the permanent magnet and effective in the particular armature arm to which that print element is connected will be compensated or offset through selective control of the respectively associated magnetic core and coil subsystem. Whenever the magnetic bias is effective the respective armature arm, as stated, is retracted and thereby mechanically tension biases the armarture arm is a resilient fashion while upon compensation of this permanent magnetic field the resilient arm relaxes and thereby through this spring relaxation propells the print element in forward direction. Such a print system is generally very effective and is widely used, whereby particularly a very high number of print positions are obtainable per second. Any limitation here results from the total time actually needed for each print element to be propelled forward to provide the dot printing and to be retracted thereafter. These three temporal parameters together limit the print speed.

Basically, one distinguishes between two different systems or type of systems; in one system characters are formed on a serial basis, the characters of a line are printed in sequence by the print head as it travels across the entire line. Alternatively, line printers provide concurrent printing of all, or of at least many characters, on a particular line. In the case of a serial operation the characters are formed individually and all individual dots of a particular character will be produced by the same or by different print elements depending on the contour of that character. In the case of line printing the print element are all arranged in one horizontal line, for example, 66 print elements per head accommodate one line as far as printing characters is concerned, but strictly speaking, all these elements operate in one horizontal dot line and position so that for forming any complete character a relative motion is needed in addition between the print medium and the print head and in a direction transversely to that line in order to yield so to speak the vertical dimension of each character. In case of line printing of this type the matrix print head as such is constructed as and is usually also designated a so-called hammer bank. This hammer bank basically oscillates in the horizontal during operation, covering at least one, possibly two, width dimensions (maximum) of characters to be printed. The displacement of the hammer bank is quite minimal which is, as far as overall speed is concerned, its major advantage but the cost, of course, is considerably higher as compared with a matrix print head which in its entirety has to be moved back and forth along the entire priting platen.

Generally speaking, systems constructed of the type to which the invention pertains have been successfully practiced, and are used, in fact, in large quantities in printers throughout. Nevertheless, it was found that on one hand the amount of magnetic energy to be controlled and handled is quite high and should be reduced for a variety of reasons, while, on the other hand, the particular construction principles involved entail considerable tight tolerances which are prone to lead to problems while on the other hand their observance is a significant cost factor.

In accordance with German Pat. No. 30 17 903 and European patent application (published) No. 9873, it is known to provide a matrix print head of the type referred to above with a disc-shape spring, and to construct the individual arms as radially inwardly extending protrusions of that disc, whereby reinforcement or armature pieces are provided near the tips of these protrusions or arms, in which the print elements, such as needles or wires, are mounted. This type of construction is disadvantaged by the fact that inherently the energy consumption is relatively high, and here reference is particularly made to the energy needed to compensate temporarily the magnetic field provided by the permanent magnet or by an electromagnetic biasing circuit. Particularly, armature arms are guided in slots of a cover plate, and are arranged transversely to these springs. These slots exhibit highly undesired stray flux losses which, in the long run, diminish the effective force of the permanent magnet. A reduction in the force provided by the permanent magnet is directly effective as a slow-down of the retraction of the armature arm whenever the compensated field has dropped and now the armature arm and the actuated print element are supposed to be retarcted from the print position, as fast as possible. In order to offset this aspect it is apparent that in those cases in which armature arms are guided in slots of a cover plate extremely high accuracies have to be observed, i.e. the tolerances of all participating parts have to be extremely tight, which, of course, is possible in principle but quite expensive.

Further, in accordance with the state of the art, it was found that the known arrangement of and with a permanent magnet is disadvantages by the fact that the magnetic flux will inevitably be weakened through field dissapation, i.e. through emanation of undesired stray flux into adjoining components. Also it was found that the known construction, as far as the resilient spring arm mounting is concerned, exhibit disadvantages on configurations.

DESCRIPTION OF THE INVENTION

It is an object of the present invention to provide a new and improved matrix print head with electromagnetic actuation, wherein the decay of magnetic fields and flux of any permanent magnet and/or of effective electromagnets are more efficient, particularly under avoidance of undesired stray fluxes, under observance of at least sufficient accuracy of the structure as a whole as well as of its constituent components, without, however, being required to establish this accuracy through extreme close and tight tolerances that have to be observed during the manufacture of individual parts and/or of their assembly in the head as a whole.

In accordance with the preferred embodiment of the present invention, it is suggested to provide a matrix print head which meets the following requirements and has the following features. There is to be a single uncritical parasitic air gap between an armature plate or disc and respective, associated armature arms, and a magnetic yoke plate being provided for mounting individual magnetic cores and core/coil combinations on one hand, and the armature arms themselves on the other hand. Furthermore, the armature plate is radially recessed with respect to a permanent magnet that provides bias to all of the drive system members.

The manufature of such a matrix print head does indeed not require extremely tight tolerances as far as the individual components are concerned, because the accuracy of operation does not depend (or only minimally so) on the accuracy of the individual parts. Moreover, the construction is chosen such that any undesired stray flux, particularly in the range and vicinity of the armature arms, are simply not set up. Another particular advantage is to be seen in the fact that the magnetic flux of the permanent magnet will be run, without extensive stray flux losses, inot the armature arms owing to a drastic local increase in concentration of the flux line on account of the construction that deviates from prior art practice. The invention, moreover, avoids the provision of slots in a yoke plate (see German Pat. No. 3,017,903) for purposes of guiding resilient armature arms as has been practiced in the prior art.

An organization scheme for a matrix print head as presently envisioned is of advantage both from the point of view of manufacture as well as from the point of view of assembly; the scheme involves basically an assembly of all the electromagnetic coils and of electromagnetic actuating system on one hand, and an assembly that includes all of the armatures. The operation in that sense is favorably obtainable between the magnetic yoke plate on one hand, and the common armature plate, on the other hand, if an intermediate plate is provided for establishing a common plane together with the front ends of all the magnetic pole cores. Herein it is of advantage to provide an accurate level adjustment between that intermediate plate and the magnetic pole cores subsequent to final assembly and through a common surface finishing operation which, in fact, then establishes that common plane. In this case, the armature arms will be thinner than the armature plate.

The effective magnetic force can be increased, of course, through reduction of magnetic stray fluxes within a given system. This is obtained in that also this intermediate plate is recessed with respect to the permanent magnet along the inside as well as along the outside. The abutment of the armature arms at the magnetic cores, the length of the resilient portion of the armature arm, the clamping and mounting of the resilient armature arms, are all features which can be improved further by alternatively requiring that the thickness of the armature plate corresponds to the thickness of the armature arms, in which case the magnetic cores have to be shorter and will not extend to a plane in which the intermediate plate and the armature plate interface. A particular step is provided facing the armature arms, the step being worked into the armature plate, and the remaining surface of the armature plate is fastened to relatively short spring arms which, in turn, thus physically connects the armature arms to the armature plate.

Moreover, the magnetic stray flux can be reduced further or even eliminated for purposes of reducing the dimensions of the magnetic circuit for purposes of intensifying the flux and for reducing the energy which has to be extracted from the permanent magnet in that the magnetic yoke plate ends with that surface position of the cores which face the print elements. The control of the magnetic flux is, moreover, improved further by the aforementioned recessing of the intermediate plate vis-a-vis the permanent magnet plate.

The matrix print head as described thus far can be deemed to be configured as a hammer bank in a matrix printer that offers the advantages of a line printer. In this case, all of the various plates referred to above are basically of bar-like configuration. On the other hand, a matrix print head for serial character formation obtains in that the flux in the magnetic yoke plate, the permanent magnet plate, the intermediate plate of the electromagnet assembly, as well as the armature plate of the armature subassembly are all annularly configured and are arranged in concentric relationship.

Manufacture, assembly, and overall construction of the matrix print head in accordance with the invention are further characterized by the fact that a casing is used which is made of a material that is neither electrically nor magnetically conductive, and is comprised of two parts, i.e. casing sub-parts, which can be interconnected. The electromagnetic coil and energization assembly is provided in one of the housing parts, and the armature assembly is centrally arranged in the other housing part. The connection between the two housing parts, therefore, establishes in fact the completion of mounting of the matrix print head. On the other hand release of the two housing parts permits ready access to all of the various parts in case certain maintenance or replacement of parts is required, and can, therefore, be carried out rather rapidly and with relative ease.

In case of a serial matrix type print head, it is of further advantage to provide the yoke plate in annular configuration and to close, so to speak, the central opening of this plate by means of a printed circuit board which provides the connections to the respective electromagnetic coils. This then facilitates the connection of these coils to plug connections and cables.

As mentioned earlier, the inventive assembly includes basically a magnetic yoke plate, a permanent magnetic plate, and an intermediate plate all configured with appropriate dimensions, as well as an armature plate having certain steps. Using such parts and assembly thereof leads to a significant radial distance between the electromagnetic coils on one hand, and the center axis of the head as a whole, on the other hand. This is particularly of advantage for maximizing the number of print elements and of the requisite drivers and armature arms. Customary contemporary matrix print heads have usually just 9 print needles or styli and drivers, but an increase to 18 and more is now more easily available than before. A print head with 18 or 24 print needles, or even more, is readily available for letter quality printing even without multiple printing passes. This is particularly so as the number of print elements arranged in an annular cluster covers more than one print column, so that with a single high speed pass under alternating utilization of these columns, a very high rate of character printing is available while a letter quality printing also in a single pass is readily available. All this is made possible through an appropriate cluster arrangements of the drive elements constructed in accordance with the invention wherein juxtaposition does not entail mutual interference.

DESCRIPTION OF THE DRAWINGS

While the specification concludes with claims particularly pointing out and distinctly claiming the subject matter which is regarded as the invention, it is believed that the invention, the objects and features of the invention, and further objects, features and advantages thereof will be better understood from the following description taken in connection with the accompanying drawings in which:

Figure 1:
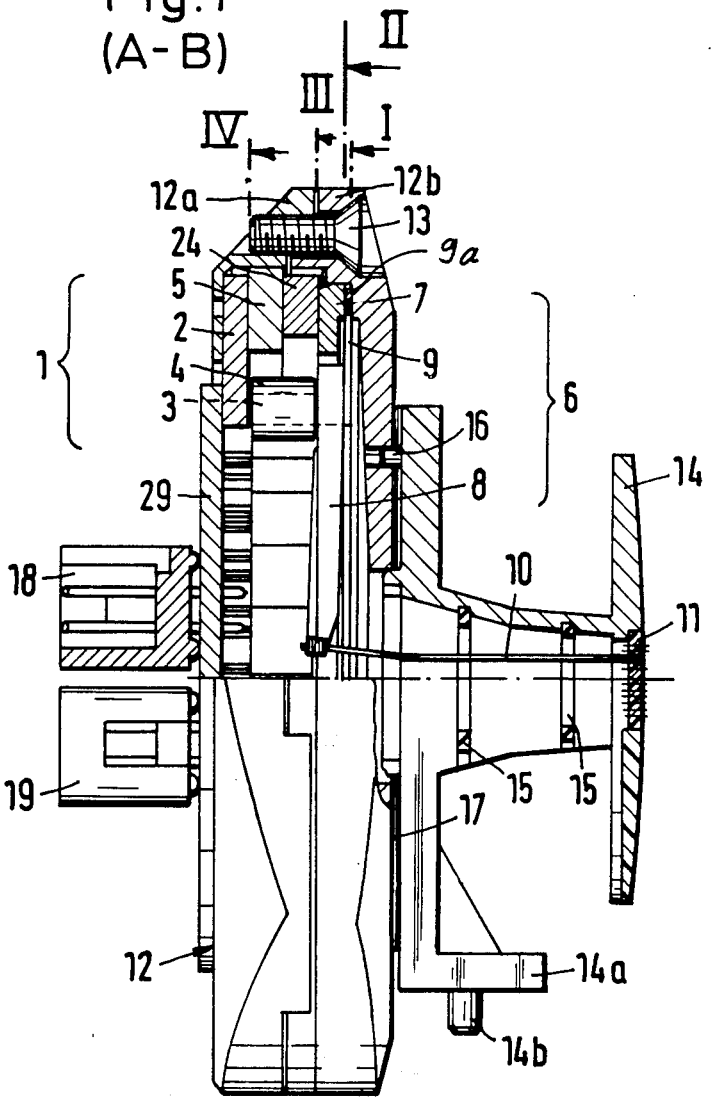
FIG. 1 is a partial cross-sectional view, partial side elevation of a matrix print head for serial printing, and constructed in accordance with the preferred embodiment of the present invention for practicing the best mode thereof, FIG. 1 illustrating several section planes identified by Roman numerals.

Proceeding with detailed description of the drawings the figures show a serial matrix print head with an electromagnetic subassembly or assembly 1 which is comprised of a magnetic yoke plate 2; a plurality of magenetizable and pole defining core 3, being fastened to the yoke plate 2 in an annular arrangement; electromagnetic coils 4, respectively mounted and seated on the cores 3; and of a permanent magnet disc or ring plate 5. The sub-group 1 faces an armature group or assembly 6 which is comprised of an armature ring 7 and of a plurality of armature arms 8 which, as per FIG. 1, can be deflected to the left and to the right. These armature arms 8 are fastened to the armature ring 7 by means of relatively short spring arms 9. Arms 8 are magnetically coupled to ring 7 in radial direction via an annular air gap 20.

The number of core 3, of electromagnetic coils 4, of armature arms 8 and of spring arms 9 are identical, and they correspond to the number of print elements 10 which in this particular embodiment and example are configured as relatively long print needles, wires or styli. The front end of each of these print elements 10 is mounted and slidably held in a mouth piece 11. Presently about 24 such print elements are provided within a casing or housing 12 which conducts neither electricity nor magnetic field lines. The housing 12 is comprised of the two housing or casing parts **12*a* and 12*b* which are interconnected by means of bolts or screw 13** and along their common periphery.

The print element 10 each will undergo a travel path of 0.3 to 0.6 mm for each printing operation. The elements, i.e. the wires styli or needles are mounted inside a casing or housing 14, permitting essentially axial displacement within bearing mounts 15 being contained in that housing or casing 14. The casing or housing 14 is accurately positioned and connected to the housing 12 there being indexing pins 16 interposed.

Adjusting shims or annuli 17 are arranged between the housing or casing 12 and the housing or casing 14. In view of the fact that each print needle or wire has a particular fixed position in relation to and inside housing 12, the adjustment of the respective print wire tips vis-a-vis the mouth piece 11 is obtained through interpositioning of these thin shims 17. By selecting an appropriate number of such shims 17 one can, indeed, adjust the special (distance) relationship between the mouth piece and the print needles 10 on one hand, and the casing and driver construction on the other hand. This kind of an assembly is of advantage because changes can be made here through changes in the number of the shims which are being interposed.

The guide housing 14 serves also for fastening the matrix print head to a carriage which is not shown and which rides on an appropriate rail to pass along the printing platen. Again, the platen and the rail are not shown; this arrangement is conventional. In order to adjust initially the position of the print head in relation to the reciprocating carriage, a fastening and mounting flange of L-shaped configuration **14*a* is provided, there being in addition indexing pins 14*b***.

Electric current is fed to the electromagnetic coils 4 through appropriate connections which may include a printed circuit board as well as plug connections 18 and 19, and a suitable cable connection by means of which electric current is run from a control circuit to the individual coils 4. The control circuit (not shown) includes a character generator and a character selection circuit to obtain selectively in any particular instant for a pattern of energization and non-energization of the individual coils 4 of the plurality of such coils in the head assembly.

Figure 3:
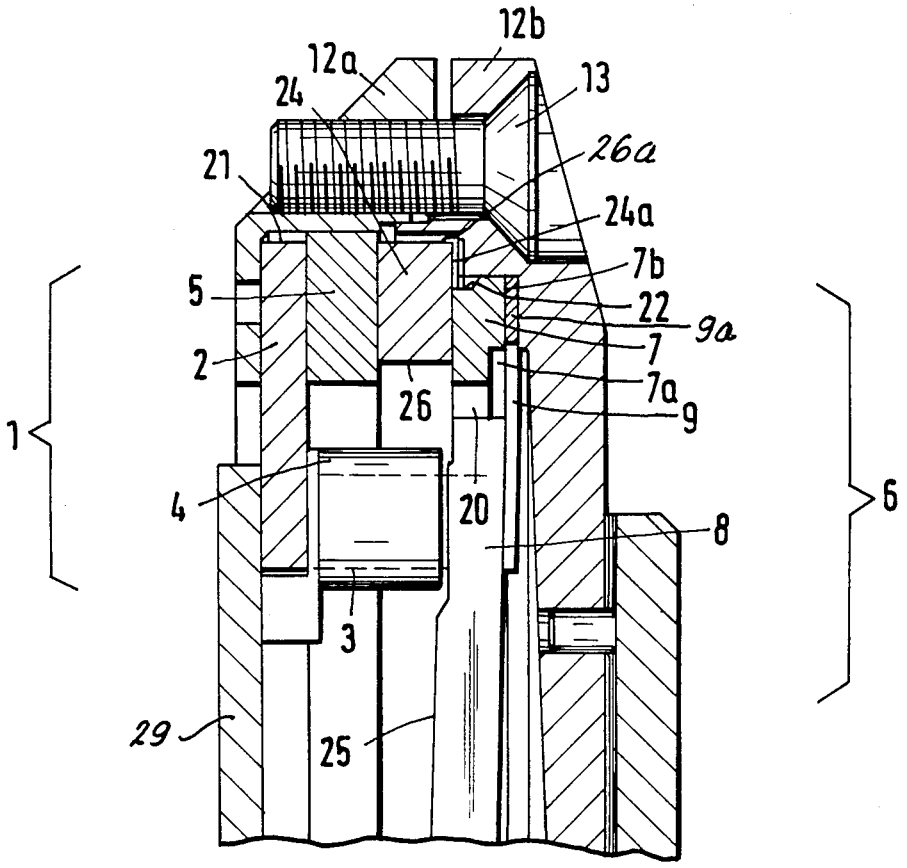
FIG. 3 is an axial partial section of FIG. 1 but in an enlarged scale.

Turning now to FIG. 3, one can readily see that a step 21 is formed by and adjacent the periphery of the yoke plate 2 and magnet; and a step 22 is formed analogously between the armature plate 7 and permanent magnet plate 5. In particular steps 21 and 22 are provided through recessing parts 2 and 7 from magnet 5 causing a "throttling" or concentration of the magnetic field lines. The air gap 20 is provided on the inside of ring 7 which remains uncritical if optimum magnetization of air occurs therein. Such optimum magnetization of the air gap 20 is provided whenever the air gap is sufficiently large so that on one hand variations in the gap width have very little influence on the flux that traverses it, which means that only small tolerances are required for making the gap defining parts and the respective surfaces of element 7 and 8. On the one hand the field line density has to be sufficiently high in order to balance the tension bias of the spring arms 9 for purposes of permitting complete relaxation of the spring arms during the print element propelling phase, while on the other hand, the field density does not have to be too high so as not to interfere with the rapid decay of the magnetic field provided by the permanent magnet as the individual electromagnetic coil 4 is turned on for purposes of offsetting that permanent magnetic bias locally, and as far as a particular coil core armature needle subassembly is concerned. The ideal situation as defined in that manner is actually present in the particular construction chosen as per this inventive example.

A particular intermediate plate or ring 24 is provided between the yoke plate 2 and the armature ring 7. This intermediate plate or annulus 24 has generally a front side or face 24*a* which is configured to be situated in a common plane 25; that plane is visible in FIG. 3. The armature ring 7 has a surface which is a surface-to-surface abutment with the plate surface 24*a* right in that plane 25 whenever the two housing parts 12*a* and 12*b* are interconnected. The cores 3 are slightly recessed from that plane; alternatively, the arms 8 can be made thinner so that cores 3 do end in plane 25 which may then become a common surface finishing plane.

The armature arms 8 when retracted, as shown in FIG. 1, are oriented slightly obliquely to the plane 25, as they abut the respective magnetic coils 3. Herein then the thickness of armature ring 7 corresponds to the thickness of the armature arms 8. The thickness of the respective spring arm 9 is small and by means of that arm armature arms 8 and armature ring 7 are interconnected. The resilient arms 9 in each instance are very short and they extend from common ring 9*a*. A shortened connection length obtains through a step 7*a* in the ring 7, and only the remaining annular armature surface 7*b* remains available for the requisite connection to ring 9*a*. The step 7*a*, moreover, ensures complete freedom of bending for the armature arm 8 by operation of the respective spring arm 9. The step 7*a* can actually be regarded as a continuation of the air gap 20. Alternatively, it is feasable to provide the resilient arms 9 of an antimagnetic material such as chromium-nickel-steel so that magnetic field lines will not run across and through the arms 9 nor enter the area or space of the steps 7*a*.

Further limiting of any stray flux, i.e. a concentration of the magnetic field lines is carried out through yoke plate 2. This yoke plate is configured in that it ends radially inwardly approximately at least, along the innermost circle defined by all of the magnetic cores 3, and where the cores 3 radially inwardly face the print elements 10. Finally, it should be mentioned that the intermediate plate 24 is also set back radially vis-a-vis the permanent magnet plate 5, defining accordingly a step 26, but along the inside of the respective annuli. A further step is obtained by the outside recessing, 26*a* of plate or ring 24 vis-a-vis magnet 5.

The magnetic print head as depicted is generally assumed to serve as print head in a serial operating printer whereby then the yoke plate 2, the permanent magnet plate 5, the intermediate plate 24, all pertaining to the electromagnetic assembly, as well as the armature plate 7 of the armature assembly are all arranged in annular configuration and they are all arranged concentrically in relation to each other as illustrated in the drawing. In the case of a line printer, particularly FIG. 3, can be construed a vertical section through a hammer bank extending at right angles to the plane of the drawings, in which case elements 2, 5, 24, 7, and 9*a* are of bar-like construction.

Figure 2:
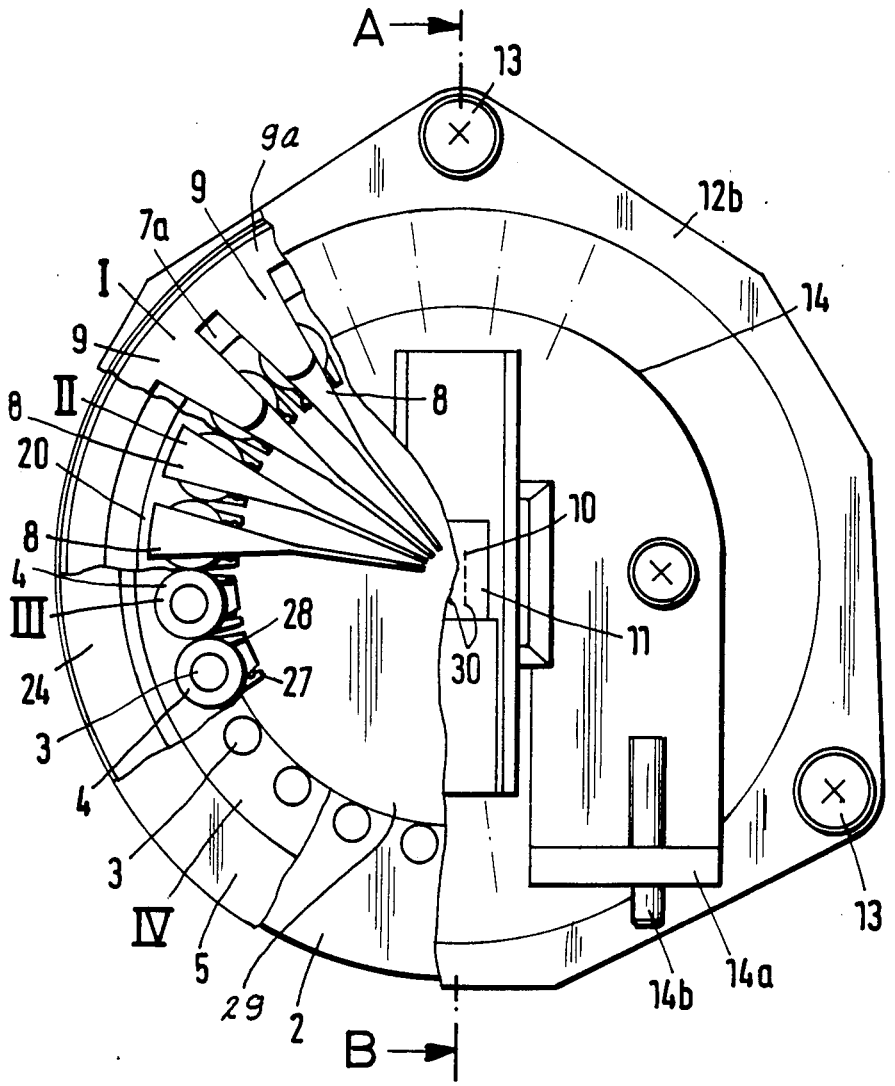
FIG. 2 is a sectional, partially, elevational view, sectionalized around a center with separate idenfication of several section planes by the Roman numerals as per FIG. 1. Also FIG. 2 indicates a plane A, B, which is the section plane of FIG. 1.

In order to maintain some manufacturing tolerances, and for ease of assembly, it is of advantage to provide an arrangement such as the electromagnetic assembly 1 so as to be situated and mounted in the casing part 12*a*, and the armature assembly is essentially arrranged in the other casing part, namely casing part 12*b*. The yoke plate 2 if of an annular configuration has its center opening closed by means of a printed circuit board 29 which holds the electric conductors 27 and 28 for and leading to the coils 4. The print elements 10 are arranged opposite to the printed circuit board 29, particularly in the case of an annular configuration of such a matrix print head. If there are more than 18 print wires, for example 24 print wires or needles, then 2 columns are provided for and in the mouth piece 11 with, for example, 12 wires and wire tips for each column. This feature is illustrated in some detail in FIG. 2.

The invention is not limited to the embodiments described above, but all changes and modifications thereof, not constituting departures from the spirit and scope of the invention, are intended to be included.

I claim:

1. A matrix print head including a common magnetic yoke plate, magnetic pole defining cores annularly arranged on said yoke plate, electromagnetic coils mounted on said cores, a common permanent magnet plate arranged in magnetic conductive relationship to said yoke plate; said yoke plate, said cores, said coils, and said permanent magnet plate establishing an electromagnetic assembly, there being additionally a common annular armature assembly including an armature plate and a plurality of deflectable radially extending armature arms, said armature assembly arranged in relation to the electromagnetic assembly such that the armature arms cooperate with said electromagnetic cores, there being print elements connected to said armature arms the improvement comprising:

said armature plate being an annulus that extends around a common center, and said radially extending armature arms being physically separated from the armature plate in radial direction but being resiliently interconnected to establish a single uncritical parasitic radial air gap; and said magnetic yoke plate and said armature plate being radially, inwardly recessed vis-a-vis said permanent magnet plate, so that the permanent magnet plate has a larger radial outward extension through said yoke plate and said armature plate.

2. The improvement as in claim 1 including an intermediate plate interposed between said yoke plate and said armature plate, said intermediate plate coplanar interfacing with said armature plate.

3. The improvement as in claim 2 said intermediate plate being likewise radially, recessed in relation to said permanent magnet plate, at least along one of the following, radial inside and radial outside.

4. The improvement as in claim 2 there being a relatively short resilient arm provided between each of said armature arms and said armature plate having a radial step.

5. The improvement as in claim 1 there being a two-part housing, a first one of the housing part containing essentially said electromagnetic coil assembly, the other part of the housing containing essentially said armature assembly.

6. The improvement as in claim 1 wherein said yoke plate is annular having a central opening being essentially closed by means of an electrical printed circuit board including electrical conductors connected to said electromagnetic coils.

* * * * *